US011661317B2

(12) United States Patent
Boros

(10) Patent No.: US 11,661,317 B2
(45) Date of Patent: May 30, 2023

(54) SIDE MONITORING DEVICE FOR A PASSENGER TRANSPORT SYSTEM

(71) Applicant: INVENTIO AG, Hergiswil (CH)

(72) Inventor: Csaba Boros, Dunajska Streda (SK)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/593,988

(22) PCT Filed: Apr. 2, 2020

(86) PCT No.: PCT/EP2020/059386
§ 371 (c)(1),
(2) Date: Sep. 29, 2021

(87) PCT Pub. No.: WO2020/207895
PCT Pub. Date: Oct. 15, 2020

(65) Prior Publication Data

US 2022/0144594 A1 May 12, 2022

(30) Foreign Application Priority Data

Apr. 12, 2019 (EP) ..... 19168965

(51) Int. Cl.
*B66B 25/00* (2006.01)
*B66B 29/00* (2006.01)
(Continued)

(52) U.S. Cl.
CPC ..... *B66B 25/006* (2013.01); *B66B 29/00* (2013.01); *B66B 29/02* (2013.01); *B66B 29/04* (2013.01); *B66B 21/04* (2013.01)

(58) Field of Classification Search
CPC ..... B66B 25/006; B66B 21/04; B66B 29/00; B66B 29/02; B66B 29/04
(Continued)

(56) References Cited

U.S. PATENT DOCUMENTS 2,637,432 A * 5/1953 Hohnecker ..... B66B 29/02 198/323
4,669,597 A 6/1987 Langer et al.
(Continued)

FOREIGN PATENT DOCUMENTS

CN 101508398 B 4/2011
DE 3637400 A1 5/1987
(Continued)

OTHER PUBLICATIONS

International Search Report for International Application No. PCT/EP2020/059386 dated Jun. 23, 2020.

*Primary Examiner* — James R Bidwell
(74) *Attorney, Agent, or Firm* — Knobbe Martens Olson & Bear LLP

(57) ABSTRACT

A side monitoring device for a passenger transport system is described. The device monitors a force application upon a base plate of the passenger transport system along a gap formed between a transport band of the passenger transport system and the base plate. The device includes a mounting structure, at least one elongate belt, and a force sensor. The mounting structure is configured for the installation of the device in a base plate region of the passenger transport system adjacent to a transport region. A belt is functionally connected to the mounting structure and extends parallel to at least a portion of the traveling path. The force sensor is functionally connected to the belt and configured for detecting a force exerted upon the mounting structure by the belt in a direction of displacement extending parallel to the traveling path.

13 Claims, 4 Drawing Sheets

(51) Int. Cl.
*B66B 29/02* (2006.01)
*B66B 29/04* (2006.01)
*B66B 21/04* (2006.01)

(58) Field of Classification Search
USPC ..... 198/323
See application file for complete search history.

(56) References Cited

U.S. PATENT DOCUMENTS

| | | | | |
|---|---|---|---|---|
| 5,695,040 | A * | 12/1997 | Watanabe | B66B 29/02 198/333 |
| 6,601,688 | B1 * | 8/2003 | Stoxen | B66B 29/005 198/333 |
| 8,636,134 | B2 | 1/2014 | Fargo | |
| 2012/0006647 | A1 * | 1/2012 | Ye | B66B 29/02 198/327 |

FOREIGN PATENT DOCUMENTS

| | | | |
|---|---|---|---|
| JP | 2001247286 | A | 9/2001 |
| JP | 2009190863 | A | 8/2009 |
| KR | 101224794 | B1 | 1/2013 |
| KR | 101406260 | B1 | 6/2014 |

* cited by examiner

SIDE MONITORING DEVICE FOR A PASSENGER TRANSPORT SYSTEM

TECHNICAL FIELD

The present application pertains to a side monitoring device for a passenger transport system such as an escalator or a moving walkway.

SUMMARY

Passenger transport systems in the form of escalators or moving walkways respectively serve for transporting passengers along inclined or horizontal traveling paths within buildings or structures by means of a transport band. In this case, the transport band extends in a transport region of the passenger transport system and comprises multiple tread units that are arranged behind one another and coupled to one another, wherein said tread units are usually referred to as steps in escalators and as pallets in moving walkways.

In order to delimit the transport region of the passenger transport system laterally, e.g., transverse to the traveling path, so-called base plates are usually provided adjacent to the transport region on both opposing sides. The base plates are arranged stationarily on the passenger transport system and usually extend from a position, in which they are vertically located laterally adjacent to the tread units, up to a height that lies slightly, e.g., a few centimeters or a few decimeters, above a plane, in which the tread surfaces of the tread units extend. Such base plates are conventionally realized in the form of simple plane or locally bent metal sheets. Balustrades usually extend adjacent to and/or above the base plates in order to also laterally delimit the transport region at heights, e.g., up to 1 m. A handrail may be held and guided on a balustrade.

In order to prevent friction between the stationary base plates and the tread units being displaced in the transport region and to thereby minimize wear, a small gap is provided between a surface of the base plate that is directed toward the transport region and an opposing lateral edge of the transport region or the local tread units, respectively. The gap normally has a size of a few millimeters, e.g., between 1 mm and, 3 mm. The gap typically extends in a vertical plane parallel to the transport region.

During the operation of the passenger transport system, it cannot be ruled out that a person protrudes beyond the lateral edge of a tread unit, e.g., with a foot or an article of clothing such as shoe. In this case, the foot or shoe may protrude as far as the base plate such that undesirable or even dangerous friction can occur between the static base plate and the foot or shoe being moved along the traveling path by the tread unit. Under unfavorable circumstances, part of the foot or shoe may even be jammed in the gap between the tread unit and the base plate and thereby lead to injuries or damages, respectively.

KR 101406260 B1 describes a safety device for an escalator or a moving walkway, by means of which injuries or damages due to jamming in the gap between the tread units and the base plate should be prevented. Rollers or balls, which at least partially bridge the gap, are mounted on the base plate in this case. However, the described approach is technically elaborate and/or sensitive, e.g., to dirt accumulations and mechanical overloads, respectively.

JP 2009 190863 A discloses a system for monitoring displacements of base plate sections by means of switches arranged behind the base plate. When a base plate section is displaced relative to the tread units by jammed objects, the switches are activated due to the deformation by means of deformation strips fastened at the joints of the base plate sections. The disadvantages of this solution can be seen in the presence of open joints between the base plate sections, which can lead to injuries, as well as the large number of required switches, which are expensive and lead to an increased susceptibility to malfunctions of the entire safety system.

Among other things, there may be a demand for a side monitoring device for a passenger transport system, by means of which the risk of injuries or damages due to jamming in the gap extending laterally adjacent to the tread units can be reduced, wherein said side monitoring device has a relatively simple technical design and/or is largely insensitive, e.g., to dirt accumulations and mechanical overloads, respectively. There may also be a demand for a passenger transport system with such a side monitoring device.

Such a demand can be met with the systems, methods, and devices of the present disclosure. Advantageous embodiments are defined in the claims, as well as the following description.

According to a first aspect of the application, a side monitoring device for a passenger transport system is proposed. The side monitoring device is configured for monitoring a force application upon a base plate of the passenger transport system along a gap formed between the transport band of the passenger transport system and the base plate. To this end, the side monitoring device comprises a mounting or mounting structure, at least one elongate belt and a force sensor. The mounting is configured for the installation of the side monitoring device in a base plate region of the passenger transport system adjacent to a transport region, in which multiple tread units of the transport band, which are arranged behind one another and coupled to one another, are displaced along a traveling path during the operation of the passenger transport system. The belt is functionally connected to the mounting and extends parallel to at least a portion of the traveling path. The force sensor is functionally connected to the belt and configured for detecting a force exerted upon the mounting by the belt in a direction of displacement extending parallel to the traveling path. The side monitoring device furthermore comprises a supporting device, which is stationarily held in the base region after its installation and arranged on a side of the belt lying opposite of the transport region, wherein the supporting device supports the belt against a motion that is directed laterally away from the transport region.

In other words, the side monitoring device may comprise a supporting device that supports the at least one belt of the side monitoring device from a rear side, e.g., from the side lying opposite of the transport region. In this case, the supporting device can prevent an excessive lateral motion of the belt away from the transport region when a force is applied to the belt from the transport region. A stability and/or rigidity of the supporting device may be significantly greater than that of the belt of the side monitoring device. For example, the supporting device may extend along the entire length or at least along a predominant portion of the belt in the form of a plate of sorts. In this case, the supporting device may be designed and/or installed similar to a conventional base plate.

According to a second aspect of the application, a passenger transport system is proposed, wherein said passenger transport system comprises multiple tread units that are arranged behind one another, coupled to one another and can be displaced along a traveling path within a transport region, as well as a side monitoring unit according to an embodiment of the first aspect of the application. In this case, the mounting of the side monitoring device is installed in a base plate region adjacent to the transport region and the belt of the side monitoring device extends parallel to at least a portion of the traveling path. Furthermore, the supporting device is stationarily held in the base region after its installation and arranged on a side of the belt lying opposite of the transport region. In this case, the supporting device supports the belt against a motion that is directed laterally away from the transport region.

Potential characteristics and advantages of embodiments of the disclosure may, among other things, be considered as being based on the ideas and realizations described below without thereby restricting the disclosure.

Embodiments of the side monitoring device presented herein may be designed for detecting when the gap between the transport band and the base plate of a passenger transport system is bridged, for example by a user or his article of clothing, and a force is in the process exerted toward the base plate. In this case, the force initially may act toward the base plate predominantly orthogonal, e.g., transverse to a traveling path, along which the transport band of the passenger transport system moves. However, since the user including his clothing is moved together with the transport band, a force in a direction of displacement extending parallel to the traveling path may be generated due to the pressure exerted toward the base plate by the user or his clothing, respectively. This force acting in the direction of displacement can be used as an indicator to the effect that the gap adjacent to the transport band has been respectively bridged by the user or his clothing and a potentially dangerous situation has therefore occurred.

In order to implement the described functionality, the side monitoring device comprises at least one mounting, at least one elongate belt and at least one force sensor.

The side monitoring device can be mounted in a so-called base plate region adjacent to the transport region of the passenger transport system with the aid of the mounting. For example, the mounting may be fixed on a component, particularly a supporting component, of the passenger transport system with the aid of a screw joint or another fastening technique.

In this case, the mounting may be realized in such a way that the entire side monitoring device extends along the transport region or at least a portion of the transport region laterally adjacent to the transport region and in the direction of its extent. The mounting may furthermore be realized in such a way that the side monitoring device or at least its at least one belt is located laterally adjacent and just vertically above the tread units moving along the transport region. In this case, the at least one belt may extend along the transport region or at least a portion of the transport region in the direction of its extent.

The belt should have an elongate shape, e.g., its length should be significantly greater than its width and thickness. The length of the belt may correspond to the length of the transport region or at least a portion of the transport region, e.g., to at least 50% of the length of the transport region. The width of the belt may correspond to or be smaller, preferably significantly smaller, than a height of a typical base plate. For example, the width of the belt may be smaller than 15 cm, preferably smaller than 10 cm or 5 cm, particularly smaller than 3 cm. The thickness of the belt may be significantly smaller than its width, e.g., the thickness of the belt may amount, for example, to less than 30%, preferably less than 10%, of the width of the belt.

The belt may be realized such that it can be subjected to a tensile load and respectively is bendable or flexible transverse to a direction of tension. In this case, the belt may have a certain extensibility. However, the extensibility and elasticity in response to a tensile load should not be so high that forces acting in the direction of displacement predominantly lead to an extension of the belt without causing a significant force transfer to other regions of the belt by the belt being extended. The extensibility of the belt particularly should be sufficiently low for ensuring a desired force transfer to the force sensor, which is functionally connected to the belt.

The belt is functionally connected to the mounting. In other words, a weight and/or a force acting upon the belt can be diverted to the mounting and to the passenger transport system via this mounting. In this case, the belt may be directly connected to the mounting in a mechanical manner. Alternatively, the belt may be connected to the mounting by means of other intermediate components.

The belt is held by the mounting in such a way that it largely extends parallel to at least a portion of the traveling path of the passenger transport system. For example, the belt may at least extend parallel to the portion of the traveling path, in which the users set foot on the tread units in order to be transported thereby. Alternatively, the belt may only extend along an inclined portion of the traveling path of a passenger transport system in the form of an escalator, but not necessarily along the horizontally extending entry and/or exit regions. The belt preferably should be arranged in such a way that one of the surfaces of the belt is directed and exposed toward the transport region such that the surface of the belt forms a lateral boundary of sorts of the transport region.

Furthermore, the belt and the force sensor are functionally connected to one another. In other words, the force sensor should be mechanically connected to the belt directly or indirectly in such a way that a force acting upon the belt in the direction of displacement can be at least partially transferred to the force sensor and consequently detected thereby.

During the operation of the passenger transport system, the side monitoring device makes it possible, for example, to detect when a user protrudes beyond the gap adjacent to a tread unit with his shoe and contacts the local belt of the side monitoring device. Since the shoe is transported along the traveling path by the tread unit together with the user, a force is exerted upon the belt in the direction of displacement parallel to the traveling path as a result of this mechanical contact. This force can be detected by the force sensor. Suitable measures can be initiated upon such a detection. For example, the operation of the passenger transport system can be temporarily stopped, a traveling speed of its transport band can be reduced or other measures can be taken in order to prevent jamming of the shoe or endangering the user otherwise.

According to an embodiment, the belt may be held in such a way that it can be displaced over a displacement distance in the direction of displacement.

In other words, the belt may be directly or indirectly held by the mounting in such a way that it can be displaced at least over a certain displacement distance in the direction of displacement without damage when a force is exerted upon the belt in the direction of displacement. Put another way, the belt may be displaceable along the direction of its extent at least over the displacement distance, e.g., within a displacement range. Although the belt is only displaced within the displacement distance, only a low force, which counteracts the displacement, preferably can be exerted upon the belt in this case. Accordingly, the belt can be moved with low forces, for example, less than 150 N, preferably less than 50 N or less than 20 N, within the range specified by the displacement distance. The counteracting force may be constant over the displacement range or successively increase as the displacement progresses.

When a user contacts the belt of the side monitoring device, for example with a shoe, the belt therefore can move in the direction of displacement at least within the specified displacement distance together with the shoe being moved along by the tread unit. The friction, which would otherwise occur between the moving shoe and a stationary base plate, can thereby be prevented. In addition, this potentially makes it possible to prevent the shoe or another object from deforming due to friction with the base plate and subsequently getting caught in the gap between the tread unit and the base plate. The user possibly has sufficient time for once again pulling the shoe back on the tread unit while the belt is displaced within its displacement distance together with the shoe in a largely force-free manner. A corresponding warning message can optionally be output upon contacting the belt of the side monitoring device.

The connection of the belt to the mounting on the one hand and to the force sensor on the other hand may be realized in such a way that a force required for activating the force sensor is only exerted upon the force sensor by the belt when the belt is displaced beyond the displacement distance.

In this case, the displacement distance may amount, for example, to at least 50 cm, at least 1 m or at least 2 m. Consequently, the belt can be moved over a substantial displacement distance when it is contacted by an object being moved along by a tread unit such that a user optionally has sufficient time for pulling the object away from the belt and on the tread units.

According to an embodiment, the mounting may be supported on the supporting device. In other words, the mounting may be mechanically connected to supporting components of the passenger transport system by means of the supporting device.

According to some embodiments, the supporting device may comprise guide structures on its surface that is directed toward the belt, wherein said guide structures are configured for guiding the belt vertically and transverse to the direction of displacement during its displacement in the direction of displacement.

Put another way, the supporting device may not only be designed for supporting the belt from its rear side, but also for ensuring that the belt is guided vertically and transverse to the direction of displacement during a potential displacement of the belt along the direction of displacement. The guide structures provided on the surface of the supporting device for this purpose may be realized in an elongate manner and extend along the direction of displacement.

For example, the guide structures may be realized in the form of one or more elongate depressions or grooves, in which the belt can be at least partially accommodated. The guide structures particularly may also be realized in the form of undercut grooves, wherein the belt is inserted into such an undercut groove with a portion that is realized complementary to the cross section of the undercut groove and thereby held in the groove in a form-fitting manner. The belt can be optionally displaced along the groove in this case, but cannot separate from the groove transverse to the surface of the supporting device.

The guide structures may be alternatively realized in the form of elongate webs on the surface of the supporting device and extend in the direction of displacement.

According to an embodiment, the side monitoring device may furthermore comprise a sliding element that is interposed between a surface of the supporting device and an opposing surface of the belt. In this case, a surface of the sliding element that contacts the surface of the belt may have a lower coefficient of sliding friction than a surface of the supporting device that contacts the surface of the belt.

In other words, a sliding element may be provided between the aforementioned surface of the supporting device and the opposing surface of the belt, wherein said sliding element makes it possible to reduce the friction that occurs when the belt is displaced relative to the supporting device and in the process contacts the supporting device. The sliding element may be made of a solid material or a pasty material or realized in the form of a liquid.

For example, the sliding element may be realized in the form of a solid sliding element. Such a solid sliding element may be realized, for example, in the form of a component that consists of plastic or is provided with a plastic surface. The plastics used particularly may be materials with very low coefficients of friction relative to metal surfaces of the type formed on the typically metallic supporting device. A sliding element particularly may consist of polytetrafluoroethylene or be coated with polytetrafluoroethylene.

According to an embodiment, the side monitoring device may comprise a plurality of belts that extend vertically adjacent to one another parallel to the traveling path and parallel to one another.

Put another way, the side monitoring device may comprise multiple belts that extend vertically adjacent to one another and respectively are functionally held on the mounting in such a way that they extend parallel to at least a portion of the traveling path parallel to one another and vertically on top of one another. Such belts may jointly form an overall surface of sorts, which vertically extends laterally adjacent to the transport region of the passenger transport system and at least partially spans a base plate or a supporting device located behind this overall surface. For example, the side monitoring device may comprise several dozen belts, e.g., more than 50 or even more than 80 belts. In this case, each individual belt may have a very small width, e.g., a width of a few millimeters. The belts may be arranged adjacent to one another in a vertical direction and respectively directed toward the transport region with one of their principal surfaces. Adjacent belts may directly abut on one another on their edges or be slightly spaced apart from one another. In this case, a distance between adjacent belts may be significantly smaller than a width of the belts, e.g., this distance may amount, e.g., to less than 20% of the width of the belts. For example, one of the guide structures may be respectively located between the edges of adjacent belts in order to guide the adjacent belts during their displacement motion.

It is difficult to bend a single wide belt about an axis extending orthogonal to its principal surface. Since multiple narrow belts are used in the side monitoring device instead of a single wide belt in order to essentially cover an identical surface laterally adjacent to the transport region of the passenger transport system, it is also possible to utilize the side monitoring device in curved regions of the passenger transport system, e.g., in the region, in which a horizontally extending entry region transforms into an inclined transport region of an escalator. In this case, each of the plurality of narrow belts only has to be slightly bent, wherein the individual belts can be displaced relative to one another along the direction of their extent.

According to an embodiment, the force sensor may be a strain gauge. Such a strain gauge is a robust component that has a simple design and therefore can be cost-efficiently manufactured. The strain gauge can measure a force acting thereupon, particularly a tensile force, in the form of a passive component. In this case, an electrical property such as an electrical resistance of the strain gauge changes depending on the intensity of the tensile force acting upon the strain gauge. The strain gauge may have two electrical connections, by means of which an electrical voltage can be applied in order to thereby measure the changing electrical property. One end of the belt may be mechanically connected to the strain gauge and connected to a stationary region of the side monitoring device such as its mounting by means of the strain gauge. An associated strain gauge may be provided for each of the belts in case a plurality of belts are provided in the side monitoring device.

According to an embodiment, the belt may be realized in the form of a plastic belt.

In other words, the belt may consist partially or entirely of plastic. The belt particularly may be realized in the form of an extruded plastic part. Such belts can be manufactured very cost-efficiently and/or be sufficiently robust for the application described herein.

According to an embodiment, the belt may be alternatively realized in the form of a metal strip, particularly a steel strip.

Put another way, the belt may consist partially or entirely of metal, particularly steel. Such metal strips can also be manufactured relatively cost-efficiently and/or be sufficiently robust for the intended use described herein.

In a passenger transport system according to an embodiment of the second aspect of the present disclosure, the passenger transport system may comprise a safety chain circuit with multiple safety switches that are connected to one another in series. In this case, the force sensor may form part of the safety chain circuit and be designed for opening a switching state and for thereby interrupting the safety chain circuit when it is detected that a force exceeding a minimum force value is exerted upon the mounting by the belt.

Passenger transport systems generally are subject to very strict safety requirements due to the fact that they are intended for transporting people. Consequently, a safe operating state of passenger transport systems typically is monitored with the aid of multiple safety switches or safety sensors, which potentially have different technical designs and are used at different locations. In this case, the safety switches or safety sensors are respectively realized in such a way that they only allow a current flow when a safe operating state is detected. A switchover into an electrically insulating state takes place when an unsafe operating state is detected. In this case, the safety switches or safety sensors are connected to one another in series and thereby form a safety chain. The safety chain is only closed when all its safety switches are in a closed or electrically conductive state. The safety chain is already interrupted when one of the aforementioned components is in an open state, e.g., in an electrically insulating state.

The force sensor of the side monitoring device described herein may be used as a component of such a safety chain. In this case, the force sensor itself or a logic circuit reading out this force sensor may be designed for opening a switching state, e.g., for transferring into an electrically insulating state, as soon as the force sensor detects a force that exceeds a specified minimum force value.

The minimum force value may be specified in the form of a value, up to which forces acting upon the belt of the side monitoring device in the direction of displacement should be tolerated, wherein measures for ensuring a safe operation of the passenger transport system should be initiated when said value is exceeded. For example, such a minimum force value may lie in the range of a few Newton, e.g., between 2 N and 200 N, preferably between 5 N and 100 N.

According to an embodiment of the passenger transport system, the passenger transport system may furthermore comprise a measuring device in case the force sensor is realized in the form of a strain gauge, wherein said measuring device is configured for generating a stop signal, based on which the operation of the passenger transport system can be stopped, when it is detected that a force exceeding a minimum force is exerted upon the force sensor by the belt.

In this case, the force sensor in the form of a strain gauge acts as a passive component, the electrical properties of which change when a force is applied thereupon. However, the strain gauge does not actively output a signal. Instead, its electrical properties such as its electrical resistance have to be read out by the measuring device. For example, the measuring device may form part of a control unit that controls the passenger transport system in this case. The measuring device may alternatively be realized in the form of a separate device. The measuring device can monitor the electrical properties of the strain gauge permanently or within short time intervals and generate a stop signal as soon as it is detected that the force acting upon the strain gauge exceeds the predefined minimum force value.

The stop signal can directly trigger a stop of the passenger transport system. The stop signal may alternatively be used for switching the switching state of a safety switch integrated into the safety chain into a non-conductive state and for thereby interrupting the safety chain, whereupon the control unit of the passenger transport system typically stops its operation temporarily.

It should be noted that a few of the potential characteristics and advantages of the disclosure are described herein with reference to different embodiments of the side monitoring device on the one hand and of the passenger transport system equipped therewith on the other hand. A person skilled in the art understands that the characteristics can be suitably combined, transferred, adapted or exchanged in order to realize other embodiments of the disclosure.

BRIEF DESCRIPTION OF THE DRAWINGS

Embodiments of the disclosure are described below with reference to the attached drawings, wherein neither the drawings nor the description should be interpreted in a restrictive sense.

The figures are merely schematic and not true-to-scale. Identical or identically acting characteristics are identified by the same reference symbols in the different figures.

DETAILED DESCRIPTION

Figure 1:
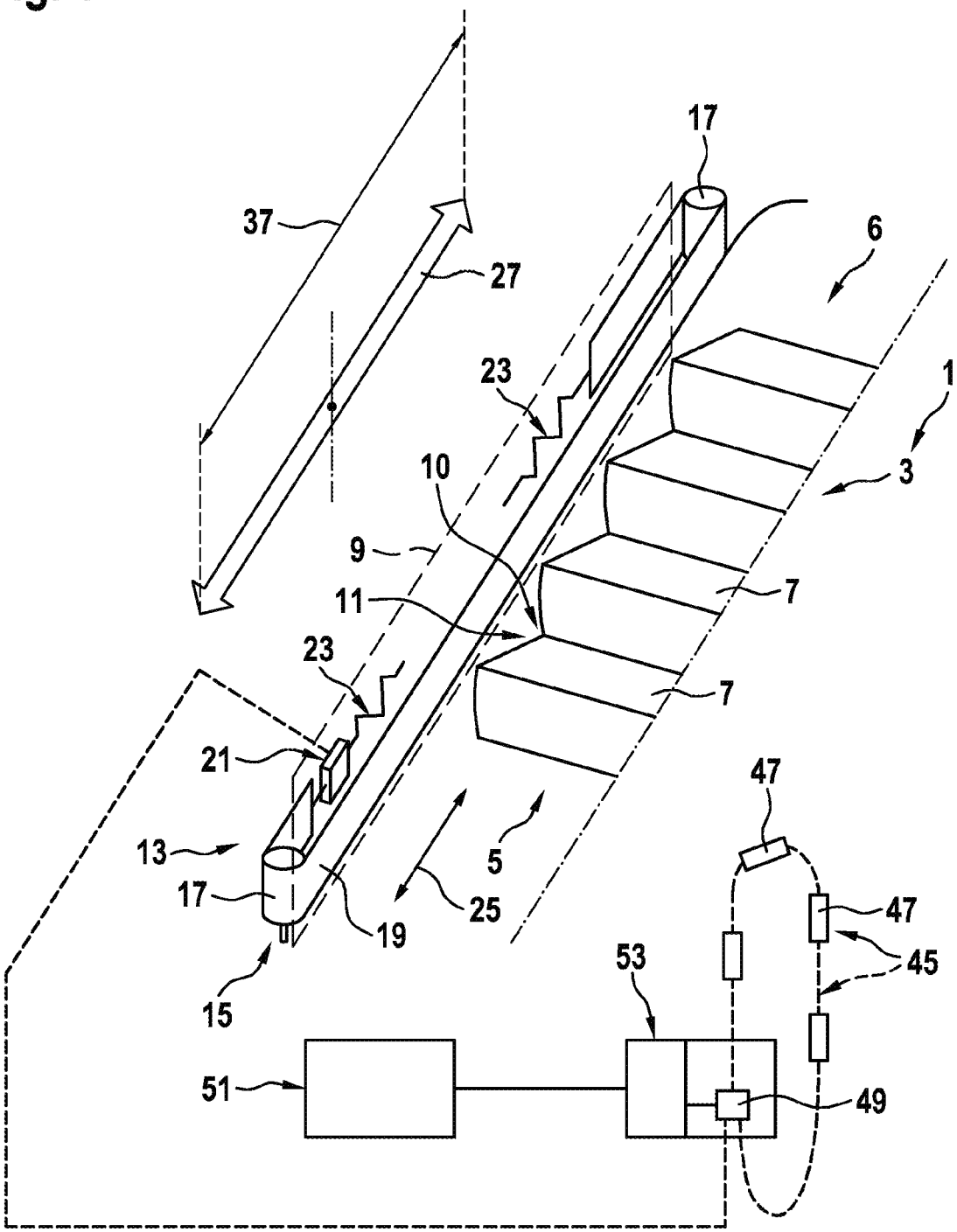
FIG. 1 shows a portion of a passenger transport system with a side monitoring device according to an embodiment of the disclosure.

FIG. 1 shows a passenger transport system 1 in the form of an escalator according to an embodiment of the present disclosure. The passenger transport system 1 comprises a transport band 5 in a transport region 6, wherein multiple tread units 7 in the form of steps are arranged behind one another along the traveling path 25 and coupled to one another in said transport band. A base plate 9 (which is merely illustrated with a broken line in order to provide a better overview) is respectively arranged on opposing sides adjacent to the transport region 6 in respective base plate regions 10. A gap 11 extends between one of the base plates 9 and an opposing edge of the transport band 5.

Figure 2:
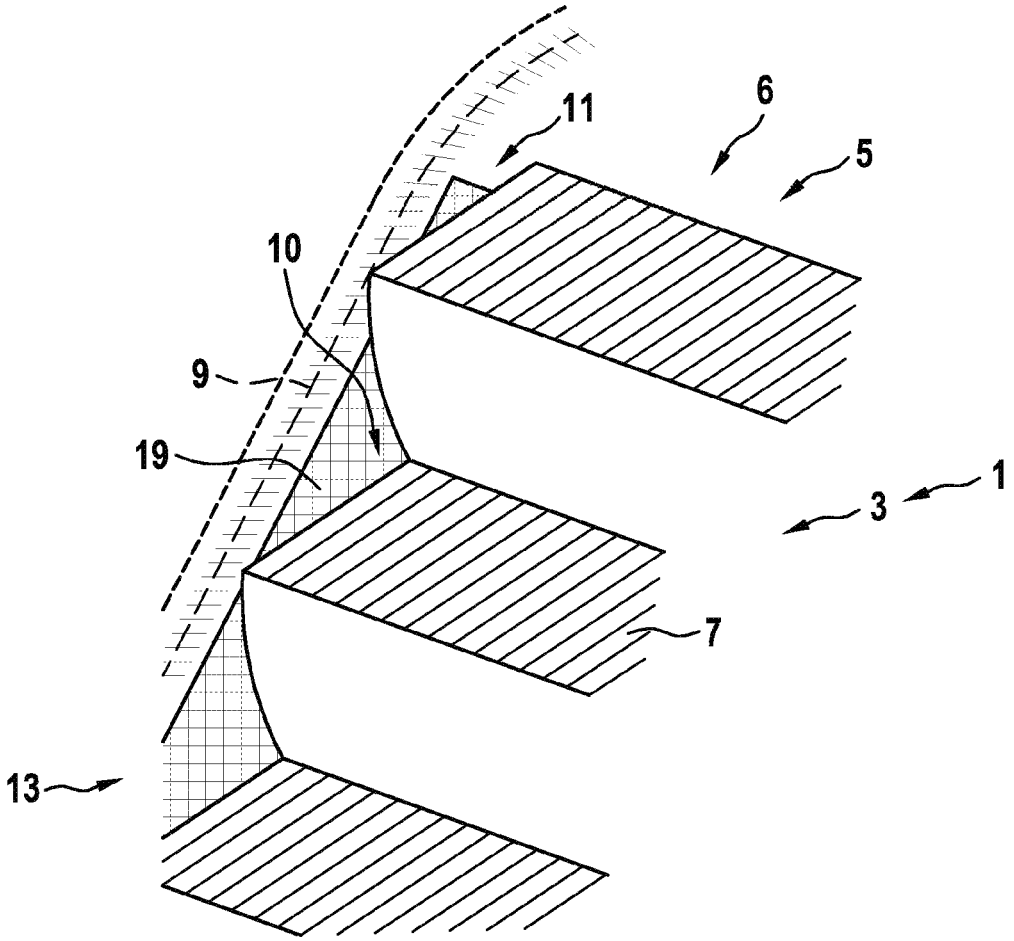
FIG. 2 shows a portion of another passenger transport system with a side monitoring device according to an embodiment of the disclosure.

The passenger transport system 1 is furthermore equipped with a side monitoring device 13 according to an embodiment of the present disclosure. The side monitoring device 13 comprises a mounting or mounting structure 15, an elongate belt 19 and a force sensor 21. The side monitoring device 13 is designed for monitoring a force application upon the base plate 9 of the passenger transport system 1 along the gap 11. According to FIG. 1, as well as an alternative embodiment illustrated in FIG. 2, the side monitoring device 13 is for this purpose arranged in the base plate region 10, e.g., laterally adjacent to the transport region 6 and therefore laterally adjacent near the transport band 5 and the gap 11, respectively.

The mounting 15 of the side monitoring device 13 is configured for installing the side monitoring device 13 in the base plate region 10 and for thereby rigidly connecting the side monitoring device to the passenger transport system 1 in a mechanical manner. This may be realized with various techniques and components, which are not illustrated in greater detail in the figures. A potential component of such a mounting 15 in the form of a deflection roller 17 is merely illustrated as an example.

The belt 19 is functionally connected to and therefore held by the mounting 15. In this case, the belt 19 and the mounting 15 are configured in such a way that the belt 19 extends parallel to at least a portion of the traveling path 25. In the example illustrated in FIG. 1, the belt 19 extends between two deflection rollers 17. At least a portion of the belt 19 is arranged in front of the base plate 9, e.g., located between the base plate 9 and the transport region 6.

In the example shown, end regions of the belt 19 are guided around the deflection rollers 17 and thereby deflected by 180°. The respective end regions of the belt 19 are functionally connected to springs 23 and mechanically held under tension by these springs 23. Due to the elasticity of the springs 23, the belt 19 is held in such a way that it can be displaced in a direction of displacement 27 parallel to the traveling path 25. In this case, the dimensions and the elasticity of the springs 23 are chosen such that the belt 19 can be displaced within a displacement distance 37.

Figure 3:
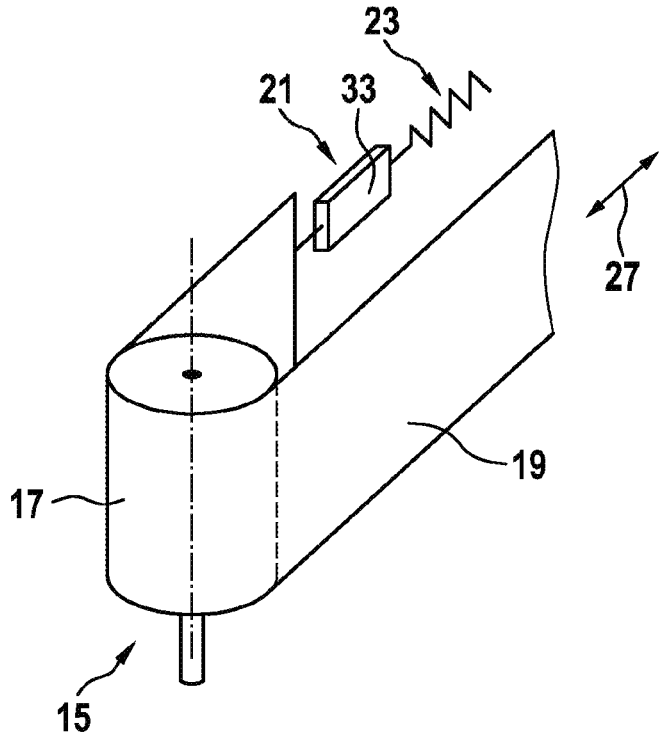
FIG. 3 shows a view of a belt and a force sensor of a side monitoring device according to an embodiment of the disclosure.

In the example shown, the force sensor 21 is arranged between one of the springs 23 and the associated end region of the belt 19 as illustrated in an enlarged manner in FIG. 3.

The force sensor 21 is mechanically connected to the belt 19 on the one hand and to the spring 23 on the other hand and configured in such a way that it can detect forces exerted upon the belt 19 in the direction of displacement 27. For example, the force sensor 21 may be realized in the form of a cost-efficient strain gauge 33, which has a simple and robust design.

Figure 4:
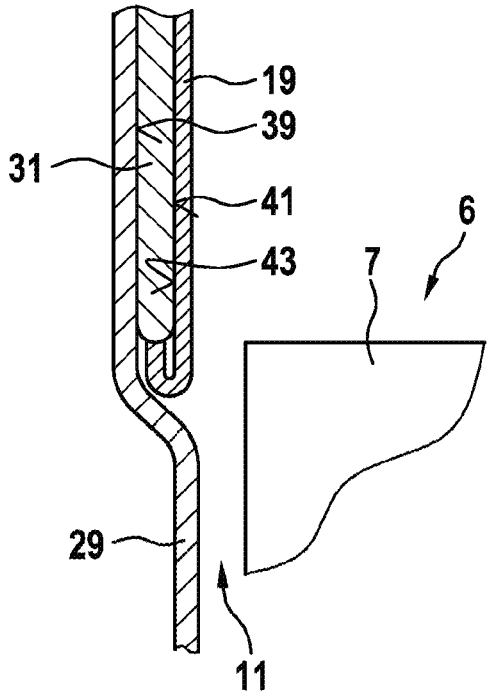
FIG. 4 shows a section through a belt of a side monitoring device according to an embodiment of the disclosure, wherein said belt is supported by a supporting device.

FIG. 4 shows a cross-sectional view in order to elucidate an option for supporting the belt 19 against a motion that is directed laterally away from the transport region 6 with the aid of a supporting device 29. In this case, the supporting device 29 in the form of a suitably bent metal sheet is functionally connected to the mounting 15 in a mechanical manner and extends on a side of the belt 19 that lies opposite of the transport region 6.

In the example shown, a planar sliding element 31 is interposed between the belt 19 and the supporting device 29. The sliding element 31 may be fastened on the supporting device 29. For example, the sliding element 31 consists of a plastic material, particularly polytetrafluoroethylene, which has a lower coefficient of sliding friction than a surface 39 of the supporting device 29 when a surface 41 of the sliding element 31 contacts a surface 43 of the belt 19. Accordingly, the friction occurring during a motion of the belt 19 relative to the supporting device 29 can be substantially reduced with the aid of the sliding element 31.

Figure 5:
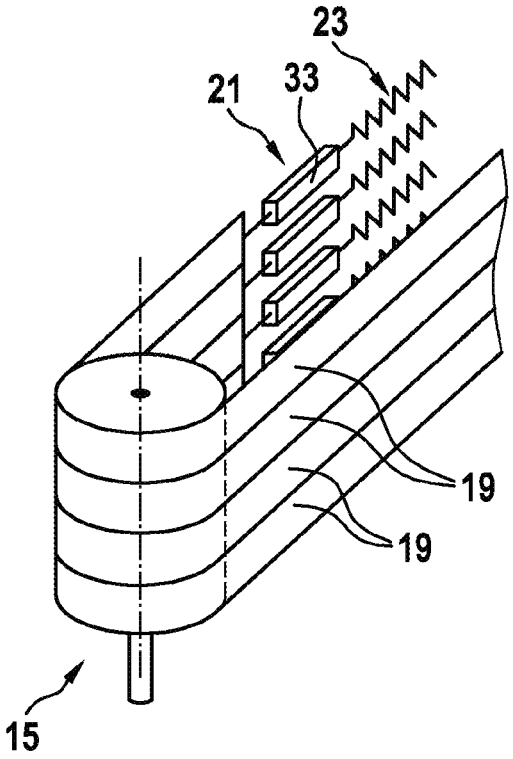
FIG. 5 shows a view of a belt and a force sensor of a side monitoring device according to an alternative embodiment of the disclosure.
Figure 6:
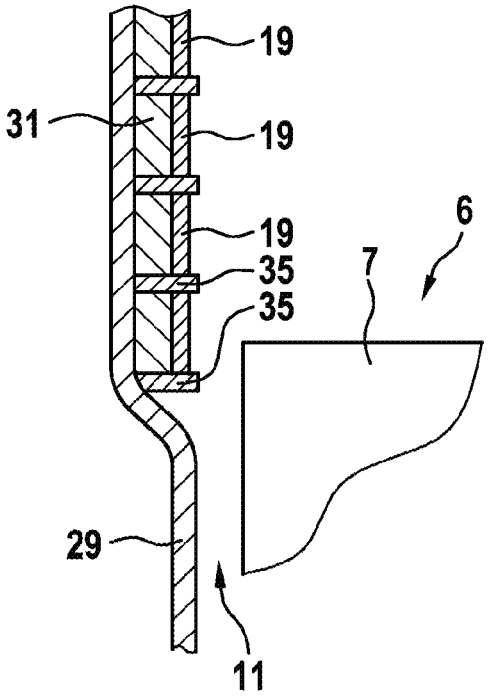
FIG. 6 shows a section through a belt of a side monitoring device according to an alternative embodiment of the disclosure, wherein said belt is supported by a supporting device.

In the exemplary embodiment illustrated in FIGS. 5 and 6, the side monitoring device 13 not only comprises a single belt 19, but rather multiple separate belts 19. In this case, each of the belts 19 extends parallel to the traveling path 25 (see FIG. 1) and is directed toward this traveling path with one of its principal surfaces. The belts 19 are arranged parallel to one another and adjacent to one another in a vertical direction. An associated force sensor 21 in the form of a strain gauge 33 is arranged on a respective end region of each belt 19, wherein the respective force sensor 21 cooperates with a respectively associated spring 23 on an opposite side. Guide structures 35 are respectively provided on the supporting device 29 between vertically adjacent belts 19 and guide the belts 19 vertically and transverse to the direction of displacement 27 during their displacement in the direction of displacement 27. Planar sliding elements 31 may also be provided between the belts 19 and the supporting device 29 in this exemplary embodiment.

In the highly schematic passenger transport system 1 according to FIG. 1, the force sensors 21 are monitored and evaluated with the aid of a measuring device 49. The measuring device 49 respectively forms part of a control unit 53 or is connected to this control unit 53. The control unit 53 serves for controlling a drive 51 of the passenger transport system 1. In this case, the control unit 53 monitors a safety chain circuit 45, in which multiple safety switches 47 are connected to one another in series. Each of the safety switches 47 may monitor a safety-relevant function of the passenger transport system 1 and transfer into an open, non-conductive state as soon as a situation that jeopardizes the safety has been detected.

The force sensor 21 may form part of this safety chain circuit 45. In this case, the force sensor or an evaluation of its properties by the measuring device 49 may be respectively realized in such a way that a switching state is opened and the safety chain circuit 45 is thereby interrupted in case the force sensor 21 detects that a force exerted by the belt 19 exceeds a minimum force value. The force sensor 21 particularly may be realized in the form of a strain gauge 33.

The measuring device 49 can generate a stop signal upon the detection of a force that exceeds the minimum force value, wherein the operation of the passenger transport system 1 can be temporarily stopped by the control unit 53 based on said stop signal.

During the operation of the passenger transport system 1, embodiments of the side monitoring device 13 described herein make it possible to detect when an object being moved along by the transport band 5, e.g., a shoe of a user, bridges or ends up in the gap 11 and subsequently contacts the belt 19 of the side monitoring device 13. A force is exerted upon the belt 19 in the direction of displacement 27 due to the fact that the object is not only pressed against the belt 19 orthogonally, but simultaneously moved in the direction of displacement 27, wherein said force can be detected by the force sensor 21. If the measured force exceeds the specified minimum force value, this excessive force can be taken into account by the control unit of the passenger transport system 1 and the operation of the passenger transport system 1 can be temporarily interrupted, for example, in that the control unit 53 stops the drive 51.

In summary and with a slightly different choice of words, embodiments of the side monitoring device 13 described herein can be referred to as passive safety devices. In case an object such as a body part, a piece of luggage or an article of clothing ends up between a tread unit 7 and a base plate 10, the preferably movable belt 19 of the side monitoring device 13 can begin to move, for example, until a safety switch 47 deactivates the passenger transport system 1. Very high loads can respectively lead to tearing of the belt 19 or the belt 19 of a plurality of belts 19, which is subjected to the highest load, wherein a belt 19 can be exchanged in a relatively simple manner.

The side monitoring device 13 may also function as an active device. For example, approximately 80-100 special belts may be provided in the side monitoring device in order to measure mechanical tensions by means of force sensors 21. This makes it possible to check the mechanical tensions of these belts 19 (on a very low level in order to prevent a short service life of the force sensors 21) or to measure locally higher tensions in the system (e.g., due to a collision of tread units 7 with the base plate 9).

It is preferred to use belts 19 because they can be easily replaced in the event of torn or damaged belts 19.

The force sensors 21 used preferably are realized in the form of very cost-efficient strain gauges 33.

According to estimates, the thickness of a panel-like side monitoring device 13 can be kept small, e.g., smaller than 20 mm, such that the side monitoring device 13 can be implemented in existing passenger transport systems in a relatively simple manner.

For example, a potential length of the permissible displacement distance 37 in the direction of displacement 27, in which the tread units 7 move (upward or downward along the traveling path 25), may amount to approximately ±0.8 m (which practically corresponds to the maximum horizontal length in a lower or upper portion of the escalator). This portion of the base plate 9 is satisfactorily protected by a safety brush (very narrow gap between an upper surface of tread units 7 and the brush).

The belt 19 may be implemented in the form of an expendable item and realized in the form of a relatively cost-efficient extruded plastic part.

In conclusion, it should be noted that terms such as "having," "comprising," etc. do not preclude any other elements or steps and that terms such as "a" or "an" do not preclude a plurality. It should furthermore be noted that characteristics or steps, which were described above with reference to one of the exemplary embodiments, can also be used in combination with other characteristics or steps of other above-described exemplary embodiments. The reference symbols in the claims should not be interpreted in a restrictive sense.

The invention claimed is:

1. A side monitoring device for a passenger transport system, wherein the side monitoring device is configured for monitoring a force application upon a base plate of the passenger transport system along a gap formed between a transport band of the passenger transport system and the base plate, and wherein the side monitoring device comprises:

a mounting structure;

at least one elongate belt; and a force sensor;

wherein the mounting structure is configured for installation of the side monitoring device in a base plate region of the passenger transport system adjacent to a transport region in which multiple tread units of the transport band, which are arranged behind one another and coupled to one another, are displaced along a traveling path during the operation of the passenger transport system, wherein the belt is functionally connected to the mounting structure and extends parallel to at least a portion of the traveling path, wherein the force sensor is functionally connected to the belt and configured for detecting a force exerted upon the mounting structure by the belt in a direction of displacement extending parallel to the traveling path, wherein the side monitoring device further comprises a supporting device, which is stationarily held in the base region after its installation and arranged on a side of the belt lying opposite of the transport region, wherein the supporting device supports the belt against a motion that is directed laterally away from the transport region.

2. The side monitoring device according to claim 1, wherein the belt is held in such a way that it can be displaced over a displacement distance in a direction of displacement.

3. The method according to claim 2, wherein the displacement distance is at least 50 cm.

4. The side monitoring device according claim 1, wherein the mounting structure is supported on the supporting device.

5. The side monitoring device according claim 1, wherein the supporting device comprises guide structures on a surface of the supporting device that is directed toward the belt, wherein said guide structures are configured for guiding the belt vertically and transverse to the direction of displacement during displacement in the direction of displacement.

6. The side monitoring device according to claim 1, further comprising a sliding element that is interposed between a surface of the supporting device and an opposing surface of the belt, wherein the surface of the sliding element that contacts the surface of the belt has a lower coefficient of sliding friction than a surface of the supporting device that contacts the surface of the belt.

7. The side monitoring device according to claim 1, wherein the at least one elongated belt comprises a plurality of belts that extend vertically adjacent to one another parallel to the traveling path and parallel to one another.

8. The side monitoring device according to claim 1, wherein the force sensor is a strain gauge.

9. The side monitoring device according claim 1, wherein the belt comprises a plastic belt.

10. The side monitoring device according to claim 1, wherein the belt comprises a metal strip.

11. A passenger transport system comprising:

multiple a plurality of tread units that are arranged behind one another, coupled to one another, and configured to be displaced along a traveling path within a transport region; and a side monitoring device according to claim 1, wherein the mounting structure of the side monitoring device is installed in a base plate region adjacent to the transport region and the belt of the side monitoring device extends parallel to at least a portion of the traveling path, and wherein the supporting device is stationarily held in the base region after its installation and arranged on a side of the belt lying opposite of the transport region, wherein the supporting device supports the belt against a motion that is directed laterally away from the transport region.

12. The passenger transport system according to claim 11, wherein the passenger transport system comprises a safety chain circuit with multiple safety switches that are connected to one another in series, and wherein the force sensor forms part of the safety chain circuit and is designed for opening a switching state and for thereby interrupting the safety chain circuit when it is detected that a force exceeding a minimum force value is exerted upon the mounting structure by the belt.

13. The passenger transport system according to claim 11, wherein the force sensor comprises a strain gauge, and wherein the passenger transport system further comprises a measuring device that is configured for generating a stop signal, based on which the operation of the passenger transport system can be stopped, when it is detected that a force exceeding a minimum force value is exerted upon the force sensor by the belt.

* * * * *